US009969604B2

(12) United States Patent
Koeninger et al.

(10) Patent No.: US 9,969,604 B2
(45) Date of Patent: May 15, 2018

(54) LIQUID PRODUCT IDENTIFICATION FOR DISPENSING IN STORAGE TANKS

(71) Applicant: Dixon Valve and Coupling Company, Chestertown, MD (US)

(72) Inventors: Robert C. Koeninger, Fairfield, OH (US); Brian DeYoung, Alexandria, KY (US); Garth L. Dexter, Liberty Township, OH (US)

(73) Assignee: Dixon Valve and Coupling Company, Chestertown, MD (US)

( * ) Notice: Subject to any disclaimer, the term of this patent is extended or adjusted under 35 U.S.C. 154(b) by 435 days.

(21) Appl. No.: 14/950,585

(22) Filed: Nov. 24, 2015

(65) Prior Publication Data

US 2017/0144878 A1 May 25, 2017

(51) Int. Cl.
*B67D 7/34* (2010.01)
*B67D 7/04* (2010.01)

(52) U.S. Cl.
CPC ..... *B67D 7/348* (2013.01); *B67D 7/04* (2013.01)

(58) Field of Classification Search
CPC ..... B67D 7/348; B67D 7/346; G06Q 10/087
See application file for complete search history.

(56) References Cited

U.S. PATENT DOCUMENTS 5,420,797 A 5/1995 Burns
5,579,233 A 11/1996 Burns
5,605,182 A 2/1997 Oberrecht et al.
5,655,577 A 8/1997 Loen et al.
5,722,469 A 3/1998 Tuminaro
RE36,510 E 1/2000 Burns
(Continued)

FOREIGN PATENT DOCUMENTS

EP 1832548 A1 9/2007
GB 2293658 A 4/1996

OTHER PUBLICATIONS

Liquip International, COPS™ (Cross-Over Protection System) Operation Manual, P59014, Issue B, Apr. 2008 (21 pages).
(Continued)

*Primary Examiner* — Timothy L Maust
*Assistant Examiner* — Timothy P Kelly
(74) *Attorney, Agent, or Firm* — Wood Herron & Evans LLP

(57) ABSTRACT

A system for confirming that a liquid product is to be dispensed into a storage tank from a tanker compartment before dispensing the liquid product is disclosed. A wand computing device generates a liquid product identification signal that identifies the liquid product contained in the storage tank when positioned within proximity of a storage tank tag associated with the storage tank. A dispense monitoring computing device attempts to match the liquid product identified by the liquid product identification signal to the liquid products identified as contained in tanker compartments. The dispense monitoring computing device generates a signal to notify the operator that an appropriate tanker compartment contains liquid product that is the same as the liquid product contained by the storage tank and can be dispensed into the storage tank when the liquid product contained by the storage tank matches the liquid product contained by the appropriate tanker compartment.

26 Claims, 4 Drawing Sheets

(56) References Cited

U.S. PATENT DOCUMENTS

| | | | | |
|---|---|---|---|---|
| 6,481,627 | B1 | 11/2002 | Guerreri | |
| 7,188,771 | B2 | 3/2007 | Poulter | |
| 8,051,882 | B2 | 11/2011 | Koeninger et al. | |
| 8,905,089 | B2 | 12/2014 | Evans | |
| 9,823,665 | B2 * | 11/2017 | Finnell | G05D 7/0629 |
| 2014/0129038 | A1 | 5/2014 | Finnell et al. | |
| 2015/0090363 | A1 | 4/2015 | Evans | |
| 2015/0186837 | A1 * | 7/2015 | Bianco | G06Q 10/087<br>235/381 |

OTHER PUBLICATIONS

Liquip Interational, Downstream News, COPS Hit the Road for BP, Issue 4, Apr. 2007 (10 pages).

FMC Energy Systems, FMC Measurement Solutions, F.A. Sening—Intelligent Tank Truck Technology, NoMix 2000 The Unique Cross-Over-Prevention System, P02051, Sep. 2000 (2 pages).

Summary Systems, Building Data Bridges to the Mobile Workforce, Fuel Delivery System™, file:///Z:/CDPS/Prior%20Art%20&%20Related%20Products/Summary%20Systems.html, Jun. 3, 2015 (1 page).

High-G-Tek, Tanker Truck Monitoring Solutions, file:///Z:/CDPS/Prior%20Art%20&%20Related%20Products/Tanker%20Truck%20Monitoring%20Solution.html, Jun. 3, 2015 (2 pages).

* cited by examiner

LIQUID PRODUCT IDENTIFICATION FOR DISPENSING IN STORAGE TANKS

BACKGROUND

Field of Disclosure

The present disclosure relates generally to the dispensing of liquid product into storage tanks and specifically to the identification of liquid product to be dispensed into storage tanks.

Related Art

Liquid products, such as gasoline, are initially dispensed into tanker transport trailers and transported to merchandisers, such as gas stations, to be emptied into storage tanks located at the merchandisers. The merchandisers may then sell the liquid products to consumers by transferring the liquid products from the storage tanks to the consumers. The tanker transport trailers include several different compartments so different types of liquid products are loaded onto a single transport trailer and then each type of liquid product is unloaded into the appropriate storage tank located at the merchandiser. For example, premium and unleaded gasoline is loaded into different compartments of the trailer and then distributed into the premium and unleaded storage tanks, respectively.

Conventional methods of dispensing the liquid products from the different compartments of the tanker transport trailers into the appropriate storage tanks include the operator manually distributing the liquid product contained in a compartment tank of the tanker transport trailer to a corresponding storage tank. In doing so, the operator manually connects an elbow to a storage tank inlet and then manually connects a hose from the elbow of the storage tank inlet to a coupler of an output of a compartment tank at the tanker transport trailer. The operator then manually initiates the dispensing of the liquid product located in the compartment tank through the hose and into the storage tank that is connected to the house. Typically, all of the outputs of a compartment tank are identical as well as the storage tank inlets with the only identification of the type of liquid product included in a compartment tank and/or to be dispensed into a storage tank is a label and/or a color identifier associated with the compartment tank and/or storage tank.

Thus, there is significant risk that the operator may mistakenly connect an elbow to the incorrect storage tank and/or connect the hose to the coupler of the incorrect compartment tank at the tanker transport trailer and dispense the incorrect liquid product into the incorrect storage tank. For example, the operator is to dispense premium gasoline from the tanker transport trailer to the storage tank. However, the operator mistakenly connects the elbow to the unleaded storage tank, connects the hose from to the compartment tank that has premium gasoline, and mistakenly dispenses premium gasoline into the storage tank that already contains unleaded gasoline. As a result, contamination of the unleaded gasoline in the storage tank occurs resulting in costly waste disposal and clean up as well as wasting the premium gasoline distributed into the storage tank.

BRIEF DESCRIPTION OF THE DRAWINGS/FIGURES

Embodiments of the present disclosure are described with reference to the accompanying drawings. In the drawings, like reference numerals indicate identical or functionally similar elements. Additionally, the left most digit(s) of a reference number identifies the drawing in which the reference number first appears.

DETAILED DESCRIPTION OF THE PRESENT DISCLOSURE

Figure 1:
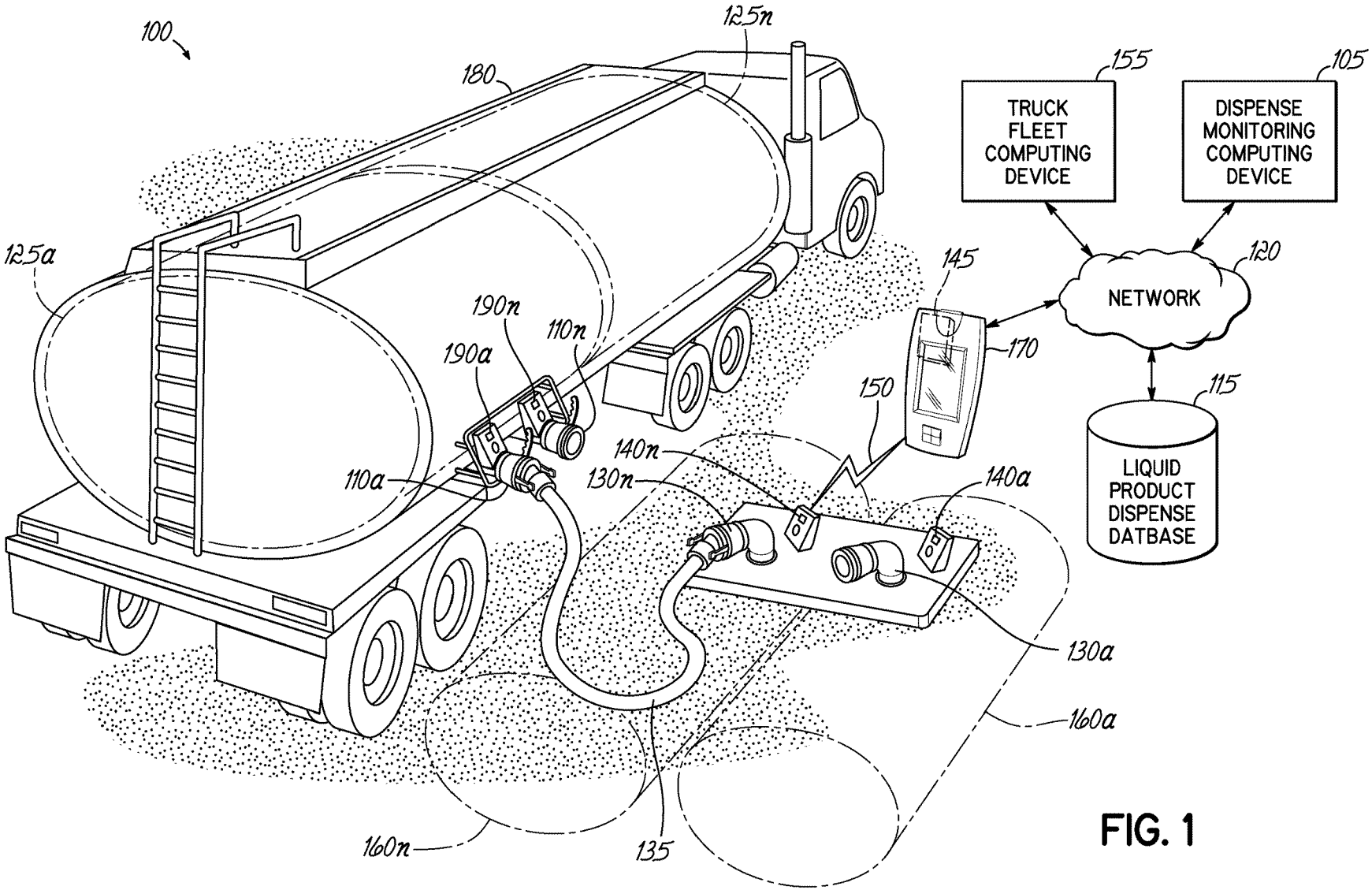
FIG. 1 illustrates an exemplary liquid product dispensing monitoring system according to an exemplary embodiment of the present disclosure.

The following Detailed Description refers to accompanying drawings to illustrate exemplary embodiments consistent with the present disclosure. References in the Detailed Description to "one exemplary embodiment," "an exemplary embodiment," an "example exemplary embodiment," etc., indicate that the exemplary embodiment described may include a particular feature, structure, or characteristic, but every exemplary embodiment may not necessarily include the particular feature, structure, or characteristic. Moreover, such phrases are not necessarily referring to the same exemplary embodiment. Further, when a particular feature, structure, or characteristic is described in connection with an exemplary embodiment, and it is within the knowledge of those skilled in the art(s) to affect such feature, structure, or characteristic in connection with other exemplary embodiments whether or not explicitly described, such other embodiments, so affected, are intended to be suggested and included in this description.

The exemplary embodiments described herein are provided for illustrative purposes, and are not limiting. Other exemplary embodiments are possible, and modifications may be made to the exemplary embodiments within the spirit and scope of the present disclosure. Therefore, the Detailed Description is not meant to limit the present disclosure. Rather, the scope of the present disclosure is defined only in accordance with the following claims and their equivalents.

Embodiments of the present disclosure may be implemented in hardware, firmware, software, or any combination thereof. Embodiments of the present disclosure may also be implemented as instructions supplied by a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical optical, acoustical or other forms of propagated signals (e.g., carrier waves, infrared signals, digital signals, etc.), and others. Further firmware, software routines, and instructions may be described herein as performing certain actions. However, it should be appreciated that such descriptions are merely for convenience and that such actions in fact result from computing devices, processors, controllers, or other devices executing the firmware, software, routines, instructions, etc.

For purposes of this discussion, each of the various components discussed may be considered a module, and the term "module" shall be understood to include at least one of software, firmware, and hardware (such as one or more circuit, microchip, or device, or any combination thereof), and any combination thereof. In addition, it will be understood that each module may include one, or more than one, component within an actual device, and each component that forms a part of the described module may function either cooperatively or independently of any other component forming a part of the module. Conversely, multiple modules described herein may represent a single component within an actual device. Further, components within a module may be in a single device or distributed among multiple devices in a wired or wireless manner.

The following Detailed Description of the exemplary embodiments will so fully reveal the general nature of the present disclosure that others can, by applying knowledge of those skilled in the relevant art(s), readily modify and/or adapt for various applications such exemplary embodiments, without undue experimentation, without departing from the spirit and scope of the present disclosure. Therefore, such adaptations and modifications are intended to be within the meaning and plurality of equivalents of the exemplary embodiments based upon the teaching and guidance presented herein. It is to be understood that the phraseology or terminology herein is for the purpose of description and not of limitation, such that the terminology or phraseology of the present specification is to be interpreted by those skilled in relevant art(s) in light of the teachings herein.

An Exemplary Liquid Product Dispensing Monitoring System

FIG. 1 illustrates an exemplary liquid product dispensing monitoring system according to an exemplary embodiment of the present disclosure used by an entity interested in ensuring that the appropriate liquid product is dispensed into the appropriate storage tank. A liquid product dispensing monitoring system 100 may ensure that an operator dispenses the appropriate liquid product from a tanker compartment positioned on a tanker transport trailer into the appropriate storage tank. For example, an operator scans a storage tank tag 140*a* with a wand 170 to determine the liquid product stored in a storage tank 160*n*. The storage tank tag 140*a* transmits a liquid product identification signal 150 that identifies the liquid product stored in the storage tank 160*n* to the wand 170. The wand 170 then transmits the identity of the liquid product stored in the storage tank 160*a* to a dispense monitoring computing device 105. The dispense monitoring computing device 105 then determines that tanker compartment 125*a* contains the same liquid product as the liquid product stored in the storage tank 160*n* and instructs the operator to dispense the liquid product stored in tanker compartment 125*a* into the storage tank 160*n*.

A tanker transport trailer 180 is a transport trailer that is capable of transporting one or more different liquid products in one or more different tanker compartments 125(*a-n*), where n is an integer equal to or greater than one. The tanker transport trailer 180 is associated with a distributor that distributes liquid products to merchandisers. For example, the tanker transport trailer 180 is associated with a gasoline distribution company that distributes gasoline to merchandisers, such as gas stations. Thus, the tanker transport trailer 180 transports gasoline stored in the tanker compartments 125(*a-n*) from the gasoline distribution company to the gas stations.

The liquid products transported by the tanker transport trailer 180 are liquid products and/or gases that can be stored in tanker compartments 125(*a-n*) and then dispensed from the tanker compartments 125(*a-n*) into corresponding storage tanks 160(*a-n*), where n is an integer equal to or greater than one, via a hose 135. For example the liquid products transported by the tanker transport trailer 180 and stored in the tanker compartments 125(*a-n*) may include but are not limited to gasoline, oil, petroleum, liquid nitrogen, argon, and/or any other type of liquid product and/or gas that can be stored by tanker compartments 125(*a-n*) and dispensed into storage tanks 160(*a-n*) via the hose 135 that will be apparent to those skilled in the relevant art(s) without departing from the spirit and scope of the disclosure.

Each of the tanker compartments 125(*a-n*) may include a dispenser 110(*a-n*), where n is an integer equal to or greater than one, and an identification tag 190(*a-n*), where n is an integer equal to or greater than one. The dispenser 110(*a-n*) may dispense the liquid product stored in the tanker compartment 125(*a-n*) when the operator releases a valve associated with the dispenser 110(*a-n*) which then releases the liquid product stored in the tanker compartment 125(*a-n*) and dispenses the liquid product through the dispenser 110(*a-n*). Often times, the operator may couple to the dispenser 110(*a-n*) a drop adapter that connects to the hose 135 so that the liquid product dispenses through the dispenser 110(*a-n*), through the drop adaptor and into the hose 135.

The identification tags 190(*a-n*) associated with each of the tanker compartments 125(*a-n*) may identify the tanker compartment 125(*a-n*) that includes the liquid product that is to be dispensed by the operator from the tanker compartment 125(*a-n*). For example, the operator is to dispense unleaded gasoline which is stored in the tanker compartment 125*a*. The identification tag 190*a* signals to the operator that the tanker compartment 125*a* is storing the unleaded gasoline that is to be dispensed by the operator. The identification tags 190(*a-n*) may signal to the operator by lighting up, blinking, generating an audible sound, and/or any other method of signaling to the operator that the tanker compartment 125(*a-n*) associated with the signaling identification tag 190(*a-n*) is storing the appropriate liquid product that is to be dispensed by the operator that will be apparent to those skilled in the relevant art(s) without departing from the spirit and scope of the disclosure. Each identification tag 190(*a-n*) may be coupled to the corresponding tanker compartment 125(*a-n*), corresponding drop adaptor coupled to each corresponding tanker compartment 125(*a-n*) and/or any other location so that the operator may easily identify the appropriate tanker compartment 125(*a-n*) to couple the hose 135 to as signaled by the identification tag 190(*a-n*) that will be apparent to those skilled in the relevant art(s) without departing from the spirit and scope of the disclosure.

The operator may then couple the hose 135 to the dispenser 110(*a-n*) of the appropriate tanker compartment 125(*a-n*) and to the appropriate storage tank 160(*a-n*) after the appropriate identification tag 190(*a-n*) signals to the operator. The storage tanks 160(*a-n*) may be located at the merchandiser and store the liquid products after the liquid products are dispensed by the tanker transport trailer 180. The liquid products may then be sold by the merchandiser to customers such that the liquid products are dispensed from the storage tanks 160(*a-n*) to the customers. For example, the storage tanks 160(*a-n*) may be underground storage tanks that store unleaded, premium, and high-octane gasoline which is then pumped from the storage tanks 160(*a-n*) by gas pumps into the cars of customers.

Each of the storage tanks 160(*a-n*) may include a receptacle 130(*a-n*), where n is an integer equal to or greater than one, and a storage tank tag 140(*a-n*), where n is an integer equal to or greater than one. The receptacle 130(*a-n*) may receive the liquid product stored in the appropriate tanker compartment 125(*a-n*) when coupled to the hose 135 from the tanker compartment 125(*a-n*) and then funnels the liquid product into the storage tank 160(*a-n*).

In an embodiment, each respective storage tank tag 140(*a-n*) may be coupled to each respective storage tank 160(*a-n*). In another embodiment, each respective storage tank tag 140(*a-n*) may be coupled to each respective receptacle 130(*a-n*). In another embodiment, each respective storage tank tag 140(*a-n*) may be coupled to each respective receptacle 130(*a-n*) and each respective storage tank 160(*a-n*). For example, a first storage tank tag 140*a* may be coupled to the receptacle 130*a* and a second storage tank tag 140*a* may be coupled to the storage tank 160*a* as well as a first storage tank tag 140*n* may be coupled to the receptacle 130*n* and a second storage tank tag 140*n* may be coupled to the storage tank 160*n*. In an embodiment, the storage tank tags 140(*a-n*) may be coupled to each end of the hose 135. The storage tank tags 140(*a-n*) may be coupled to any object associated with the respective storage tanks 160(*a-n*) so that the appropriate liquid product stored in each respective storage tank 160(*a-n*) may be adequately identified via the wand 170 as discussed in more detail below that will be apparent to those skilled in the relevant art(s) without departing from the spirit and scope of the disclosure.

The storage tank tags 140(*a-n*) associated with each of the storage tanks 160(*a-n*) may identify the liquid product contained in each of the storage tanks 160(*a-n*). For example, the operator is to dispense unleaded gasoline which is stored in the storage tank 160*n*. The storage tank tag 130*n* identifies that unleaded gasoline is indeed stored in the storage tank 160*n*. In an embodiment, each of the storage tank tags 140(*a-n*) may be Radio Frequency Identification (RFID) tags in which each of the storage tank tags 140(*a-n*) generate a liquid product identification signal 150 that identifies the liquid product contained in each of the respective storage tanks 160(*a-n*).

For example, the storage tank 160*n* contains unleaded gasoline. The storage tank tag 140*n* then generates the liquid product identification signal 150 that identifies that the storage tank 160*n* includes unleaded gasoline. The storage tank tags 140(*a-n*) may also be Near Field Communication (NFC) tags and/or any other type of tag that generates the liquid product identification signal 150 from an electromagnetic field generated by a host device when the storage tank tags 140(*a-n*) are placed within proximity of the host device that will be apparent to those skilled in the relevant art(s) without departing from the spirit and scope of the disclosure. For example, the storage tank tags 140(*a-n*) may be but not limited to high frequency 13.56 MHz RFID tags that are compliant with the ISO 15693 standard.

The storage tank tags 140(*a-n*) may generate the liquid product identification signal 150 when positioned within proximity of the wand 170. The wand 170 is a reader device that when positioned within proximity of the storage tank tags 140(*a-n*), the wand 170 generates an electromagnetic field that then powers the storage tank tags 140(*a-n*) such that the storage tank tags 140(*a-n*) generate the liquid product identification signal 150. The liquid product identification signal 150 is then received by the wand 170. The storage tank tags 140(*a-n*) are within proximity of the wand 170 when the storage tank tags 140(*a-n*) are adequately powered by the electromagnetic field generated by the wand 170 and then adequately transmit the liquid product identification signal 150 to the wand 170. In an embodiment, the wand 170 may include a 13.56 MHz RFID tag reader. However, the wand 170 may include any type of tag reader that is capable of powering the storage tank tags 140(*a-n*) to generate the liquid product identification signal 150 from the electromagnetic field of the wand 170 that will be apparent to those skilled in the relevant art(s) without departing from the spirit and scope of the disclosure.

The operator may scan the storage tank tags 140(*a-n*) with the wand 170 to identify the liquid product that is contained in each of the respective storage tanks 160(*a-n*). As the operator scans the storage tank tags 140(*a-n*), each storage tank tag 140(*a-n*) generates the liquid product identification signal 150 which contains a unique identification number that identifies the liquid product contained in each of the respective storage tanks 160(*a-n*). For example, the operator may be instructed to dispense unleaded gasoline from the tanker transport trailer 180. In order to identify the storage tank 160(*a-n*) that contains unleaded gasoline, the operator scans the storage tank tag 140*n* and the storage tank tag 140*n* generates the liquid product identification signal 150 which contains a unique identification number that identifies that the storage tank 160*n* contains unleaded gasoline.

The unique identification number may also identify liquid product type information. The liquid product type information is information that provides further insight as to the liquid product type stored in each of the storage tanks 160(*a-n*) as well as events that have occurred when attempting to dispense liquid product into each of the storage tanks 160(*a-n*). For example, the liquid product type information includes but is not limited to a date and time stamp that identifies each time liquid product is dispensed into each storage tank 160(*a-n*), the geographic location and a description of each storage tank 160(*a-n*), information specific to each dispensing operation such as the amount of liquid product dispensed, any issues that occurred and so on. The liquid product type information may identify any pertinent information associated with the storage tanks 160(*a-n*) that will be apparent to those skilled in the relevant art(s) without departing from the spirit and scope of the disclosure.

The wand 170 may also contain a wand computing device 145. The wand computing device 145 may be a wireless device that wirelessly communicates the identification data associated with the liquid product identification signal 150 with other devices. For example, the wand computing device 145 may wirelessly communicate the description and location of the storage tank 160(*a-n*) that is associated with the scanned storage tank tag 140(*a-n*) as well as the liquid product contained in the storage tank 160(*a-n*). Examples of the wand computing device 145 may include a mobile telephone, a smartphone, a workstation, a portable computing device, other mobile computing devices such as a laptop, and/or any other suitable electronic device that is capable of wirelessly communicating the identification information associated with the identification signal that will be apparent to those skilled in the relevant art(s) without departing from the spirit and scope of the invention.

In an embodiment, multiple modules may be implemented on the same communications device. Such a communications device may include software, firmware, hardware, or a combination thereof. Software may include one or more applications on an operating system. Hardware can include, but is not limited to, a processor, memory, and/or graphical user interface display. In an embodiment, the wand computing device 145 may include the wand 170. For example, the wand computing device 145 may be a smartphone that has RFID tag reading capabilities such that the wand computing device 145 includes the wand 170.

As shown, the wand computing device 145 may stream the identification data to a dispense monitoring computing device 105 and the dispense monitoring computing device 105 may query the liquid product dispense database 115 via a network 120. The network 120 includes one or more networks, such as the Internet. In some embodiments of the present invention, the network 120 may include one or more wide area networks (WAN) or local area networks (LAN). The network 120 may utilize one or more network technologies such as Ethernet, Fast Ethernet, Gigabit Ethernet, virtual private network (VPN), remote VPN access, a variant of IEEE 802.11 standard such as Wi-Fi, and the like. Communication over the network 120 takes place using one or more network communication protocols including reliable streaming protocols such as transmission control protocol (TCP). These examples are illustrative and not intended to limit the present invention.

The dispense monitoring computing device 105 determines the appropriate tanker compartment 125(*a-n*) that contains the appropriate liquid product that is to be dispensed into the appropriate storage tank 160(*a-n*) and instructs the operator accordingly based on the identification data communicated by the wand computing device 145. Initially, each of the tanker compartments 125(*a-n*) is filled with a liquid product at the location of the distributor. Often times, the location of the distributor differs from the location of the merchandisers that are to receive the liquid products contained in the tanker compartments 125(*a-n*) requiring the operator to drive the tanker transport trailer 180 to potentially several different merchandisers on a delivery route in order to deliver the liquid products to each of the merchandisers. As each liquid product is initially loaded into each respective tanker compartment 125(*a-n*), the dispense monitoring computing device 105 tracks the liquid product type that is loaded into each corresponding tanker compartment 125(*a-n*) and records the liquid product type in liquid product dispense database 115.

The dispense monitoring computing device 105 may include a data acquisition system, a data management system, intranet, conventional web-server, e-mail server, a mobile telephone, a smartphone, a workstation, a portable computing device, other computing devices such as a laptop, or a desktop computer, cluster of computers, set-top box, or file transfer server modified according to one embodiment. The dispense monitoring computing device 105 is typically a device that includes a processor, a memory, and a network interface, hereinafter referred to as a computing device or simply "computer."

In an embodiment, multiple modules may be implemented on the same dispense monitoring computing device 105. Such a computing device may include software, firmware, hardware, or a combination thereof. Software may include one or more applications on an operating system. Hardware can include, but is not limited to, a processor, memory, and/or graphical user interface display.

In an embodiment, the dispense monitoring computing device 105 may be positioned on the tanker trailer truck 180. In another embodiment, the dispense monitoring computing device 105 may be a wireless device that is positioned with the operator. In another embodiment, the dispense monitoring computing device 105 may be remote to the tanker trailer truck 180. The dispense monitoring computing device 105 may be positioned in any location that enables the dispense monitoring computing device 105 to determine which tanker compartment 125(*a-n*) on the tanker transport trailer 180 that the operator is to dispense the appropriate liquid product into the appropriate storage tank 160(*a-n*) and instruct the operator accordingly that will be apparent to those skilled in the relevant art(s) without departing from the spirit and scope of the disclosure.

The dispense monitoring computing device 105 may record which liquid product is dispensed into each corresponding tanker compartment 125(*a-n*). The dispense monitoring computing device 105 may associate an identification number with each liquid product loaded into each tanker compartment 125(*a-n*) that identifies each respective liquid product. For example, unleaded gasoline is loaded into the tanker compartment 125*a* and the dispense monitoring computing device 105 associates a unique identification number that identifies the liquid product loaded into the tanker compartment 125*a* as unleaded gasoline.

In an embodiment, the dispense monitoring computing device 105 may record which liquid product is loaded into each corresponding tanker compartment 125(*a-n*) based on an identification signal generated by the identification tag 190(*a-n*) associated with each tanker compartment 125(*a-n*). As the liquid product is loaded into the tanker compartment 125(*a-n*), an operator may identify the liquid product via the corresponding identification tag 190(*a-n*). The corresponding identification tag 190(*a-n*) may then generate an identification signal and transmits the unique identification number of the liquid product loaded into the tanker compartment 125(*a-n*) to the dispense monitoring computing device 105.

For example, unleaded gasoline is loaded into the tanker compartment 125*a*. The operator may then select unleaded gasoline as the liquid product being loaded into the tanker compartment 125*a* via the identification tag 190*a*. The identification tag 190*a* then generates the identification signal and transmits the unique identification number identifying the liquid product loaded into the tanker compartment 125*a* as unleaded gasoline to the dispense monitoring computing device 105. The dispense monitoring computing device 105 may then record the unique identification number in a liquid product storage database 115 indicating that the liquid product contained in the tanker compartment 125*a* is unleaded gasoline.

In another embodiment, the dispense monitoring computing device 105 may record which liquid product is loaded into each corresponding tanker compartment 125(*a-n*) based on an identification signal generated by the wand computing device 145. As the liquid product is loaded into the tanker compartment 125(*a-n*), the operator may identify the liquid product via the wand computing device 145. The wand computing device 145 may then generate an identification signal and transmits the unique identification number of the liquid product loaded into the tanker compartment 125(*a-n*) to the dispense monitoring computing device 105. The dispense monitoring computing device 105 may then record the unique identification number in the liquid product storage database 115.

In another embodiment, the dispense monitoring computing device 105 may record which liquid product is loaded into each corresponding tanker compartment 125(*a-n*) by downloading a load manifest from a truck fleet computing device 155. In an embodiment, the truck fleet computing device 155 may be distinct from and located remote from the dispense monitoring computing device 105 and may track liquid product dispensing operations for the distributor. In another embodiment, the truck fleet computing device 155 and the dispense monitoring computing device 105 may be the same device and located remote from the tanker trailer truck 180.

For example, the truck fleet computing device 155 may track the dispensing of liquid products by several tanker transport trailers with each of the tanker transport trailers dispensing different liquid products to different merchandisers. In doing so, the truck fleet computing device 155 may generate load manifests for each tanker transport trailer. The load manifests provides dispensing information for each tanker transport trailer, such as the delivery route for each tanker transport trailer, the type of liquid product contained in each tanker compartment, the amount and type of liquid product to be dispensed in each storage tank at each merchandiser, and/or any other type of dispensing information that assists an operator in accurately dispensing the appropriate liquid product into the appropriate storage tank that will be apparent to those skilled in the relevant art(s) without departing from the spirit and scope of the disclosure.

In such an embodiment, the dispense monitoring computing device 105 may download the load manifest for the tanker transport trailer 180 before the tanker transport trailer 180 departs on its delivery route. In doing so, the dispense monitoring computing device 105 may access the unique identification numbers that identifies each liquid product stored in each of the tanker compartments 125(*a-n*). The dispense monitoring computing device 105 may then communicate the dispensing information obtained from the load manifest as well as the unique identification numbers to the wand computing device 145. The operator may then accept the updated dispensing information displayed via the wand computing device 145 in which the wand computing device 145 generates a driver acceptance signal. The operator may then view the updated dispensing information via the display of the wand computing device 145. The dispense monitoring computing device 105 may record which liquid product is loaded into each corresponding tanker compartment 125(*a-n*) in any manner that adequately enables the dispense monitoring computing device 105 to identify the liquid product loaded into each corresponding tanker compartment 125(*a-n*) that will be apparent to those skilled in the relevant art(s) without departing from the spirit and scope of the disclosure.

After the tanker transport trailer 180 arrives at the storage tanks 160(*a-n*) and is in position to dispense the liquid products contained in the tanker compartments 125(*a-n*), the dispense monitoring computing device 105 instructs the operator as to which tanker compartment 125(*a-n*) is to have its liquid product dispensed into the appropriate storage tank 160(*a-n*). As noted above in conventional methods, the operator could mistakenly couple a hose to a tanker compartment and a storage tank and dispense the incorrect liquid product into the incorrect storage tank and thus contaminating the liquid product contained in the storage tank. Rather than having the operator determine the tanker compartment 125(*a-n*) that is to be coupled to a specified storage tank 160(*a-n*), the dispense monitoring computing device 105 executes the determination and instructs the operator accordingly.

Initially, the operator may select a storage tank 160(*a-n*) to dispense the liquid product contained in one of the tanker compartments 125(*a-n*). For example, the operator may select storage tank 160*n* to dispense liquid product from one of the tanker compartments 125(*a-n*). The operator may then position the wand 170 within proximity of the selected storage tank tag 140(*n*) that is associated with the selected storage tank 160*n* such that the wand 170 generates electromagnetic energy that triggers the selected storage tank tag 140(*n*) to generate the liquid product identification signal 150. The wand computing device 145 may then transmit the liquid product identification signal 150 to the dispense monitoring computing device 105 via the network 120.

The dispense monitoring computing device 105 may then compare the unique identification number transmitted by the liquid product identification signal 150 with the unique identification numbers associated with each of the tanker compartments 125(*a-n*). As noted above, the dispense monitoring computing device 105 recorded each of the unique identification numbers identifying each of the liquid products contained in each of the tanker compartments 125(*a-n*). In an embodiment, the operator may position the wand 170 within proximity of the storage tank 125*n* after the operator has coupled the hose 135 to the storage tank 125*n*. In another embodiment, the operator may position the wand 170 within proximity of the storage tank 125*n* before the operator has coupled the hose 135 to the storage tank 125*n*.

The dispense monitoring computing device 105 may then determine whether the unique identification number associated with the selected storage tank 160*n* matches a unique identification number associated with each of the tanker compartments 125(*a-n*). The unique identification number associated with the selected storage tank 160*n* that matches the unique identification number associated with any of the tanker compartments 125(*a-n*) may be indicative that the liquid product contained in the tanker compartment 125(*a-n*) is the same liquid product contained in the selected storage tank 160*n*. Thus, the dispense monitoring computing device 105 may identify the appropriate tanker compartment 125 (*a-n*) as containing the appropriate liquid product that is to be dispensed into the selected tanker compartment 125(*a-n*) when the unique identification number associated with the storage tank 160*n* matches the unique identification number associated with a corresponding tanker compartment 125(*a-n*).

For example, the dispense computing device 105 compares the unique identification numbers associated with the tanker compartments 125*a* and 125*n* with the unique identification number associated with the selected storage tank 160*n*. The dispense computing device 105 determines that the unique identification number associated with the tanker compartment 125*a* that identifies the tanker compartment 125*a* contains unleaded gasoline that matches the unique identification number associated with the selected storage tank 160*n* that also contains unleaded gasoline. Thus, the dispense monitoring computing device 105 identifies that the tanker compartment 125*a* contains the same liquid product as the selected storage tank 160*n*.

In an embodiment, the dispense computing device 105 may query the liquid product dispense database 115 to determine which unique identification numbers associated with the tanker compartments 125(*a-n*) matches the unique identification number associated with the selected storage tank 160*n*. As noted above, the liquid database 115 may store the unique identification number associated with each of the liquid products loaded into each of the tanker compartments 125(*a-n*). Thus, the dispense computing device 105 may then query the liquid product dispense database 115 to determine which tanker compartment 125(*a-n*) contains the appropriate liquid product to be dispensed into the selected storage tank 160*n*.

As will be discussed in further detail below, the wand computing device 145, the dispense monitoring computing device 105, the truck fleet computing device 155 and the liquid product dispense database 115 may share resources via network 120 in a cloud computing configuration. As a result, a liquid product dispense server (not shown) that is associated with the liquid product dispense database 115 may receive updates via the cloud computing configuration from the wand computing device 145, the dispense monitoring computing device 105 as well as the truck fleet computing device 155. Such updates may include the liquid product type currently stored in each of the storage tanks 160(*a-n*) as well as any other liquid product type information pertinent to the dispense monitoring computing device 105 accurately determining which tanker compartment 125 (*a-n*) contains the appropriate liquid product to dispense into the selected storage tank 160*n*.

In an embodiment, the liquid product computing device 105 may synchronize with the liquid product dispense database 115 to receive the most recent update of the liquid product type currently stored in each of the storage tanks 160(*a-n*) after the tanker transport trailer 180 is positioned at the storage tanks 160(*a-n*). The liquid product computing device 105 may then locate the record of each storage tank 160(*a-n*) in its own storage space and update the liquid product type information and add any additional information obtained from the liquid product dispense database 115 associated with each storage tank 160(*a-n*) that is not already stored by the liquid product computing device 105. The liquid product computing device 105 may then retrieve the most recent liquid product type information for each of the storage tanks 160(*a-n*) from its local memory and/or database.

Thus, the liquid product computing device 105 is not limited to having a wireless connection with the liquid product dispense database 115 to properly determine the appropriate tanker compartment 125(*a-n*) that contains the appropriate liquid product that is to be dispensed into the storage tank 160*n*. In such a situation where the liquid product computing device 105 does not have a wireless connection, the liquid product computing device 105 may retrieve the liquid product type information stored locally by the liquid product computing device 105 from the most recent synchronization of the liquid product computing device 105 with the liquid product dispense database 115.

The dispense monitoring computing device 105 may then instruct the operator that the tanker compartment 125*a* is the correct tanker compartment to dispense the liquid product contained in the tanker compartment 125*a* into the selected storage tank 160*n*. The dispense monitoring computing device 105 may instruct the operator by commanding the identification tag 190*a* coupled to the tanker compartment 125*a* to signal to the operator that the operator is to dispense the liquid product contained in the tanker compartment 125*a* into the selected storage tank 160*n*.

For example, the dispense monitoring computing device 105 commands the identification tag 190*a* to light up while the remaining identification tag 190*n* remains dark thus signaling to the operator to dispense the unleaded gasoline contained in the tanker compartment 125*a* into the selected storage tank 160*n*. In another example, the dispense monitoring computing device 105 commands the identification tag 190*a* to light up in the color green thus signaling to the operator to dispense the unleaded gasoline contained in the tanker compartment 125*a* into the selected storage tank 160*n*. The dispense monitoring computing device 105 also commands the identification tag 190*n* to light up in the color red thus signaling to the operator that the liquid product stored in the tanker compartment 125*n* does not match the liquid product stored in the storage tank 160*n* and should not be used to dispense liquid product into the storage tank 160*n*. As noted above, the identification tag 190*a* may signal to the operator in any type of fashion to instruct the operator that the tanker compartment 125*a* is the appropriate tanker compartment that will be apparent to those skilled in the relevant art(s) without departing from the spirit and scope of the disclosure.

The identification tag 190*a* signaling that the tanker compartment 125*a* is the appropriate tanker compartment to dispense the liquid product into the selected storage tank 160*n* provides an additional layer of assurance that the operator will correctly dispense the appropriate liquid product into the selected storage tank 160*n*. The operator no longer has to rely on the load manifest as well as labels associated with the storage tanks that may be difficult to read and/or understand the liquid product stored in those storage tanks. Typically, conventional storage tanks have similar resemblance with similar labels and manually distinguishing the storage tanks by the operator is not a trivial task. Rather, the operator simply has to focus on the identification tag 190(*a-n*) that is signaling to the operator and identifying to the operator the appropriate tanker compartment 125(*a-n*) to dispense the appropriate liquid product into the selected storage tank 160(*a-n*). Thus, damage caused by the operator dispensing the incorrect liquid product into the incorrect storage tank may be prevented. In an embodiment, the operator may then confirm that the hose 135 is coupled to the appropriate tanker compartment 125(*a-n*) by physically pressing a button associated with the appropriate identification tag 190(*a-n*) that has signaled to the operator of the appropriate tanker compartment 125(*a-n*).

In an embodiment, the identification tag 190*a* may communicate several different status levels of the tanker compartment 125*a* before, during, and after the dispensing operation such that the operator may easily recognize the status level of the tanker compartment 125*a* by focusing on the identification tag 190*a*. For example, the identification tag 190*a* may light up in different colors signaling to the operator the current status level of the tanker compartment 125*a*. In such an example, the identification tag 190*a* may light up in blue to indicate the tanker compartment 125*a* is empty of liquid product, red to indicate the tanker compartment 125*n* should not be used, green to indicate the tanker compartment 125*a* should be used, flashing red to indicate that the operator is attempting to dispense liquid product from the incorrect tanker compartment 125*n*, and flashing blue to indicate the operator has initiated the dispensing operating from the correct tanker compartment 125*a*. Any type of color coded combination presented by the identification tag 190*a* indicating any type of status level of the tanker compartment 125*n* to the operator may be implemented that will be apparent to those skilled in the relevant art(s) without departing from the spirit and scope of the disclosure. The identification tags 190(*a-n*) may also display to the operator the liquid product stored in each respective tanker compartment 125(*a-n*) as well as providing directions for loading and/or dispensing the liquid product stored in each respective tanker compartment 125(*a-n*).

In some instances, the operator may incorrectly couple the hose 135 to the tanker compartment 125*n* and to the storage tank 160*n* before the operator scanned the storage tank tag 140*n*. In such an instance, the dispense monitoring computing device 105 may alert the operator that the hose 135 is incorrectly coupled to the tanker compartment 125*n* rather than the tanker compartment 125*a* so that the operator is notified to not initiate the dispensing operation and dispense the incorrect liquid product into the storage tank 160*n*. In instances that the operator initiates the dispensing operation and dispenses the incorrect liquid product into the storage tank 160*n*, the dispense monitoring computing device 105 may once again alert the operator that the operator has initiated a dispensing operation of the incorrect liquid product into the storage tank 160*n*.

The dispense monitoring computing device 105 may also wirelessly transmit email messages and/or text messages to wireless devices associated with the operator and/or other personnel that have an interest in the dispensing operation that the operator has coupled the hose 135 to the incorrect tanker compartment 125*n*. In instances that the operator initiates the dispensing operation and dispenses the incorrect liquid product into the storage tank 160*n*, the dispense monitoring computing device 105 may again wirelessly transmit email messages and/or text messages to wireless devices associated with the appropriate personnel that the operator has initiated a dispensing operation of the incorrect liquid product. The dispense monitoring computing device 105 may instantly alert the appropriate personnel in any type of manner that quickly notifies the appropriate personnel of a potential improper dispensing operation that will be apparent to those skilled in the relevant art(s) without departing from the spirit and scope of the disclosure.

In an embodiment, a drop hose proximity sensor may be positioned on each of the dispensers 110(*a-n*). The drop hose proximity sensor may identify when the operator has coupled the hose 135 to the corresponding dispenser 110(*a-n*). The dispense monitoring computing device 105 may confirm that the operator has coupled the hose 135 to the appropriate dispenser 110*a* associated with the tanker compartment 125*a* determined by the dispense monitoring computing device 105 as being the correct. The drop hose proximity sensor coupled to the dispenser 110*a* signals to the dispense monitoring computing device 105 that the hose 135 has been coupled to the correct dispenser 110*a* enabling the dispense monitoring computing device 105 to confirm that the operator has coupled the hose 135 to the correct tanker compartment 125*a*.

The drop hose proximity sensor may also identify when the operator has coupled the hose 135 to the incorrect corresponding dispenser 110(*a-n*). The dispense monitoring computing device 105 may be alerted that the operator has coupled the hose 135 to the incorrect dispenser 110*n* associated with the incorrect tanker compartment 125*n*. The drop hose proximity sensor coupled to the dispenser 110*n* signals to the dispense monitoring computing device 105 that the hose 135 has been coupled to the incorrect dispenser 110*n* enabling the dispense monitoring computing device 105 to sound the appropriate alerts that the hose 135 is coupled to the incorrect tanker compartment 125*n*. In an embodiment, the dispense monitoring computing device 105 may trigger a valve lockout of the dispenser 110*n* preventing the operator from initiating the dispensing operation of the incorrect liquid product contained in the incorrect tanker compartment 125*n* into the storage tank 160*n*. In an embodiment, the dispense monitoring computing device 105 may trigger a valve lockout of the receptacle 130*n* preventing the incorrect liquid product contained in the incorrect tanker compartment 125*n* from entering the storage tank 160*n*.

In an embodiment, the dispense monitoring computing device 105 may command the wand computing device 145 to signal to the operator that the operator is to dispense the liquid product contained in the tanker compartment 125*a* into the selected storage tank 160*n*. In such an embodiment, the wand computing device 145 may include a user interface that may display to the operator that the tanker compartment 125*a* is the appropriate tanker compartment to dispense liquid product into the selected storage tank 160*n*. For example, the dispense monitoring computing device 105 determines that the tanker compartment 125*a* contains unleaded gasoline that is to be dispensed into the storage tank 160*n*. The dispense monitoring computing device 105 then commands the wand computing 145 to display to the operator via the user interface that the operator is to couple the hose 135 to the tanker compartment 125*a* and dispense the unleaded gasoline contained in the tanker compartment 125*a* into the storage tank 160*n*.

In another embodiment, the dispense monitoring computing device 105 may signal to the operator itself that the operator is to dispense the liquid product contained in the tanker compartment 125*a* into the selected storage tank 160*n*. In such an embodiment, the dispense monitoring computing device 105 may be positioned in a cab of the tanker transport trailer 180 and/or positioned with the operator and may have a user interface. The user interface may display to the operator that the tanker compartment 125*a* is the appropriate tanker compartment to dispense liquid product into the selected storage tank 160*n*.

After the dispense monitoring computing device 105 has instructed the operator that the tanker compartment 125*a* contains the appropriate liquid product that is to be dispensed into the storage tank 160*n*, the operator may execute the dispensing operation. The dispensing operation is the act of dispensing the liquid product from the tanker compartment 125*a* into the storage tank 160*n* including any type of data generated or action that occurs during the dispensing of the liquid product. The operator may then couple the hose 135 to the tanker compartment 125*a* and the storage tank 160*n* if the operator had not already previously done so. If the hose 135 is already properly coupled, the operator may initiate the dispensing of the liquid product contained in the tanker compartment 125*a* into the storage tank 160*n*. In an embodiment, the dispense monitoring computing device 105 may generate an alert if the operator attempts to dispense the liquid product before the dispense monitoring computing device 105 had generated the instruction to the operator as to the appropriate tanker compartment to dispense the liquid product.

As the dispensing of the liquid product commences, the dispense monitoring computing device 105 may record the pertinent liquid product type information associated with the dispensing operation. For example, the dispense monitoring computing device 105 may record pertinent liquid product type information such as but not limited to the date and time of the dispensing operation, the geographic location of the dispensing operation, the wand computing device 145 used in the operation as well as the storage tank tags 140(*a-n*) that were scanned are logged. The liquid product type information may identify any pertinent information associated with the dispensing of the liquid product that will be apparent to those skilled in the relevant art(s) without departing from the spirit and scope of the disclosure.

After the dispensing of the liquid product is completed, the dispense monitoring computing device 105 may record additional pertinent liquid product type information associated with the completion of the dispensing operation. For example, the dispense monitoring computing device 105 may record the amount of liquid product that was dispensed from the tanker compartment 125*a* into the storage tank 160*n*. The dispense monitoring computing device 105 may also calculate the amount of liquid product still contained in the tanker compartment 125*a* as wells the amount of liquid product now contained in the storage tank 160*n*. The dispense monitoring computing device 105 may record that the dispensing operation has been completed along with the date and time of completion, the GPS geographic coordinates of the dispensing operation, and the liquid product that was dispensed. The dispense monitoring computing device 105 may also record that the tanker compartment 125*a* has been emptied of the liquid product when the remaining liquid product has been dispensed into the storage tank 160*n*. The liquid product type information may identify any pertinent liquid product type information associated with the completion of the dispensing operation that will be apparent to those skilled in the relevant art(s) without departing from the spirit and scope of the disclosure.

As noted above, the wand computing device 145, the dispense monitoring computing device 105, the truck fleet computing device 155 and the liquid product dispense database 115 may share resources via network 120 in a cloud computing configuration. The cloud computing configuration enables the wand computing device 145, the dispense computing device 105, and the truck fleet computing device 155 to continuously update the liquid product dispense database 115 such that the liquid product dispense database 115 contains the most recent liquid product type information associated with any tanker compartment 125(*a-n*) and storage tank 160(*a-n*) as well as the liquid product contained in each. In an embodiment, the liquid product dispense database 115 may be a centralized database and the liquid product dispense server is a SQL server positioned in a cloud computing configuration although any type of server may be implemented to enable the cloud computing configuration that will be apparent to those skilled in the relevant art(s) without departing from the spirit and scope of the disclosure.

The continuous updating of liquid product type information stored in the centralized liquid product dispense database 115 ensures that any of the computing devices included in the cloud computing configuration may access accurate liquid product type information. The access of accurate liquid product type information further ensures that the appropriate amount of liquid product is dispensed into the appropriate storage tanks 160(*a-n*) in a timely manner. Distributors may have numerous of merchandisers that the distributors are required to distribute several different liquid products to numerous different storage tanks 160(*a-n*). In order to deliver the liquid products in a timely manner to the merchandisers, the distributors may have fleets of tanker transport trailers as well as numerous different operators completing several delivery routes a day. The coordination of such deliveries is a daunting task and as noted above, any mistake and/or late delivery has significant financial implications for the distributor. Thus, the continuous updating of liquid product type information in the liquid product dispense database 115 via the cloud computing configuration has a significant impact on the distributor's ability to satisfy the needs of the merchandisers.

For example, the truck fleet computing device 155 may initially query the liquid product dispense database 115 and determine that the storage tank 160*n* requires a delivery of unleaded gasoline. The truck fleet computing device 155 then generates a load manifest that instructs the operator to dispense unleaded gasoline into the storage tank 160*n*. However, before the tanker transport trailer 180 arrives at the storage tank 160*n*, a second tanker transport trailer arrives at the storage tank 160*n* and dispenses unleaded gasoline into the storage tank 160*n*. The liquid product dispense database 115 is updated with liquid product type information to indicate that the storage tank 160*n* has received unleaded gasoline as well as the amount dispensed and the date and time of the dispense operation.

The dispense monitoring computing device 105 then synchronizes with the liquid product dispense database 115 upon the arrival of the tanker transport trailer 180 at the storage tank 160*n*. The dispense monitoring computing device 105 then receives the updated liquid product type information indicating that the storage tank 160*n* has already received a delivery of unleaded gasoline. The dispense monitoring computing device 105 then instructs the operator to not dispense unleaded gasoline into the storage tank 160*n* despite the instructions included in the load manifest. Thus, unnecessary distribution of unleaded gasoline into the storage tank 160*n* is prevented.

The liquid product dispense database 115 may also be updated by other computing devices in which users of the computing devices manually enter data to update the liquid product dispense database 115. The updating of the liquid product dispense database 115 provides user control over the dispensing operations so that a user may intervene in dispensing operations when necessary to ensure that the dispensing operations occur accurately and in a timely manner. There may be instances where the user becomes aware of liquid product type information that may have an impact on dispensing operations that has yet to be provided to the liquid product dispense database 115 by the other computing devices. Thus, the user may be able to manually update the liquid product dispense database 115 with the liquid product type information to ensure that the other computing devices receive the updates via the liquid product dispense database 115 to prevent any unnecessary and/or untimely dispensing operations.

An Exemplary Liquid Product Dispensing Reporting System

Figure 2:
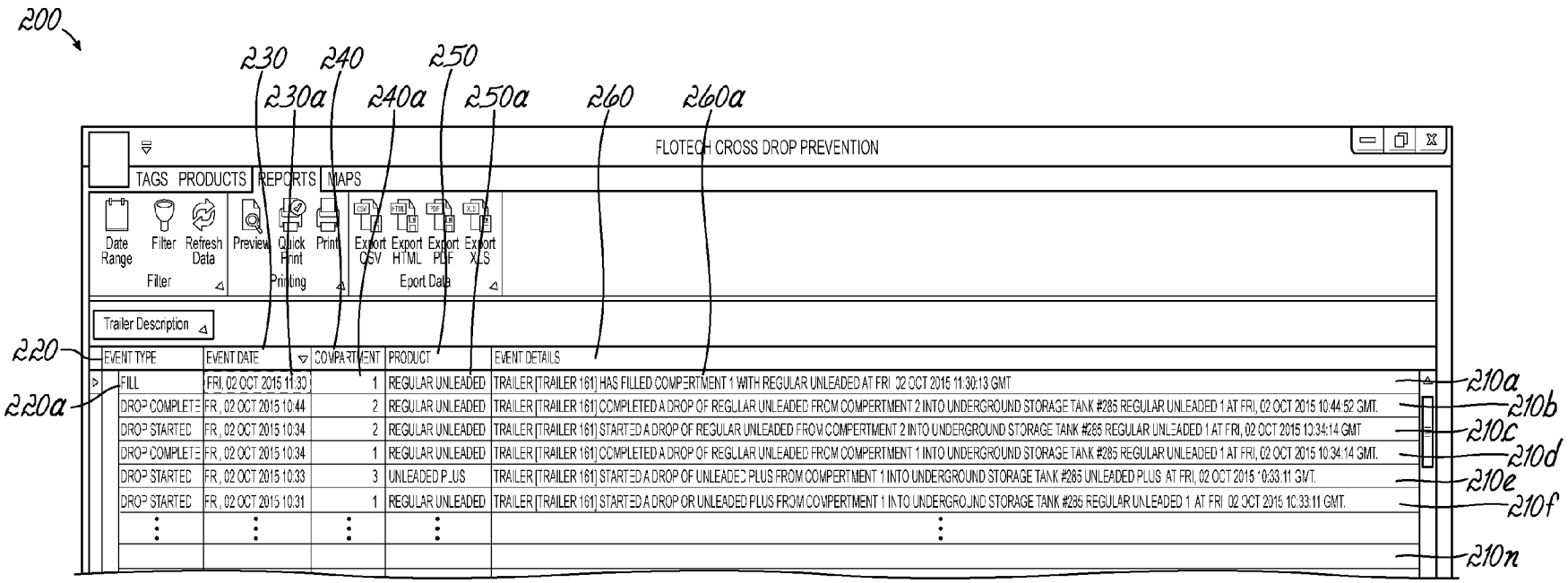
FIG. 2 illustrates an exemplary liquid product dispensing reporting system according to an exemplary embodiment of the present disclosure.

FIG. 2 illustrates an exemplary liquid product dispensing reporting system according to an exemplary embodiment of the present disclosure used by an entity interested in monitoring numerous dispensing operations that are executed on a daily basis. A liquid product dispensing reporting system 200 may provide updated liquid product type information in an organized fashion to the user such that the user may easily monitor and/or analyze the numerous dispensing operations. As noted above, the distributor may very well have hundreds of dispensing operations occurring during a 24 hour period in several geographic locations. Thus, the distributor has a significant interest in monitoring the dispensing operations to ensure the dispensing operations are being executed correctly and promptly as well as analyzing the dispensing operations after completion to determine whether more efficient approaches to the dispensing operations can be developed.

As noted above, the liquid product dispense database 115 is continuously updated by the wand computing device 145, dispense monitoring computing device 105, and/or the tank fleet computing device such that the liquid product dispense database 115 contains updated liquid product type information. The wand computing device 145, the dispense monitoring computing device 105, and/or the truck fleet computing device 155 may then generated detailed reports that provide the updated liquid product type information in easily understood format.

The detailed reports may be analyzed by distributors to assist the distributors in monitoring all of the dispense operations that occur on a real-time, daily, weekly, monthly, annual basis and so on. For example, distributors not only have a significant interest that dispense operations are executed accurately and in a timely manner but also in an efficient manner. The distributors incorporate significant cost when executing thousands of dispense operations and to improve the logistics of the dispense operations to ensure the dispense operations are being executed in an efficient manner may have significant cost savings for the distributors.

The continuous updating of the liquid product type information stored in the liquid product dispense database 115 ensures that any analysis of the reports is based on accurate liquid product type information.

The detailed reports may also be generated by any of the computing devices to provide a real-time snapshot to the user of all of the dispensing operations occurring simultaneously. As noted above, distributors may have numerous storage tanks 160(*a-n*) that the distributors are required to dispense liquid product in a timely manner. As a result, the distributors may have several dispensing operations occurring simultaneously as each tanker transport trailer operated by the distributors are executing daily delivery routes to ensure each merchandiser receives the appropriate liquid product. The generation of the detailed reports by any of the computing devices providing real-time snapshots enables the user to monitor the dispensing operations and take the necessary actions if any of the dispensing operations are not occurring as planned.

For example as shown in FIG. 2, the liquid product dispensing reporting system 200 depicts an example report. This example report provides a summary of a delivery route executed by tanker transport trailer "161". The tanker transport trailer "161" is identified based on its relationship to the other tanker transport trailers in the fleet and is thus identified as tanker transport trailer "161". The example report provides the summary of the dispensing operations 210(*a-n*) that are in the process and/or have been executed by the tanker transport trailer "161".

For each dispensing operation 210(*a-n*), the example report provides updated liquid product type information that includes but is not limited to a type of dispensing operation 220, a date/time 230 of a dispensing operation, a tank compartment 240 that is dispensing the liquid product for a dispensing operation, a liquid product type 250 being dispensed for a dispensing operation, and/or details 260 of the liquid product dispensing operation. The liquid product dispensing reporting system 200 may generate reports with any type of updated liquid product type information that may be analyzed by a user with regards to dispensing operations that will be apparent to those skilled in the relevant art(s) without departing from the spirit and scope of the disclosure.

Continuing with the example report depicted in FIG. 2, the example report includes the following updated liquid product type information for the dispensing operation 210*a*. The type of dispensing operation 220*a* is "fill" indicating that the tanker transport trailer "161" has had its required tanker compartment filled with the appropriate liquid product and is ready to initiate the dispensing operation upon arrival at the storage tank. The date/time 230*a* for the dispensing operation 210*a* is "Friday, Oct. 2, 2015 at 11:30 . . . " indicating the date and time that the tanker transport trailer "161" had its tanker compartment filled. The tanker compartment 240*a* is tanker compartment "1" indicating that tanker compartment "1" includes the appropriate liquid product to be dispensed into the appropriate storage tank. The product 250*a* is "Regular Unleaded" indicating that the liquid product to be dispensed into the appropriate storage tank is "Regular Unleaded". The operation details 260*a* indicates that the tanker transport trailer "161" has filled compartment "1" with "Regular Unleaded" on "Friday, Oct. 2, 2015 at 11:30 GMT".

As a result, any of the dispensing operations 210(*a-n*) may be easily monitored and/or analyzed based on updated liquid product type information provided in the example report. For example, the user may notice that the filling of compartment "1" at "11:30 GMT" is significantly later than planned and as a result the merchandiser awaiting the delivery of "Regular Unleaded" risks running out of "Regular Unleaded" due to the tardiness of the delivery. The user may then intervene and instruct a different tanker transport trailer that is carrying "Regular Unleaded" and can reach the merchandiser in a timely manner to execute the dispensing operation of "Regular Unleaded" to the merchandiser instead of tanker transport trailer "161" to prevent the merchandiser from running out of "Regular Unleaded".

An Exemplary Liquid Product Dispensing Mapping System

Figure 3:
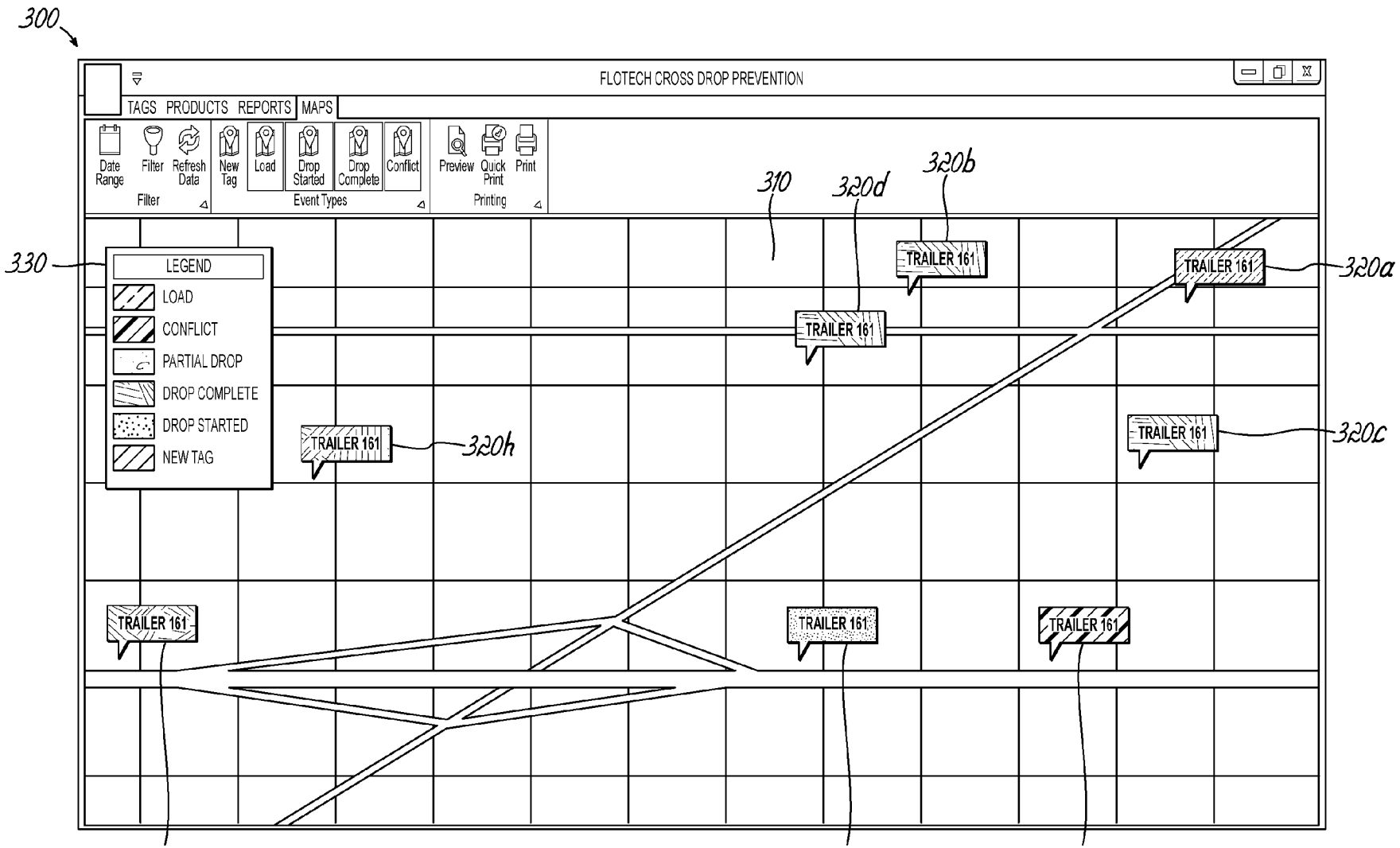
FIG. 3 illustrates an exemplary liquid product dispensing mapping system according to an exemplary embodiment of the present disclosure.

FIG. 3 illustrates an exemplary liquid product dispensing mapping system according to an exemplary embodiment of the present disclosure used by an entity interested in monitoring numerous dispensing operations that are executed on a daily basis. A liquid product dispensing mapping system 300 may provide a geographic map that depicts the dispensing operations that are scheduled for a specific geographic region. As noted above, the distributor may very well have hundreds of dispensing operations occurring during a 24 hour period in several geographic locations. The liquid product dispensing mapping system 300 enables the distributor to monitor the dispensing operations occurring in a specific geographic region by visually depicting the status and location of the dispensing operations via a geographic map.

The detailed reports generated by the wand computing device 145, dispense monitoring computing device 105, and/or the truck computing device as depicted in FIG. 2 may also be translated into geographic maps generated by any of the wand computing device 145, dispense monitoring computing device 105, and/or the truck fleet computing device 155 as depicted in FIG. 3. Rather than displaying the updated liquid product type information stored in the liquid product dispense database 115 in a text-based report as shown in FIG. 2, the liquid product type information may also be displayed in a geographic map 310 as shown in FIG. 3. The geographic map 310 may provide a map of a region that has significant dispensing operation activity. Each dispensing operation 320(*a-n*) may be displayed on the geographic map 310 in relation to the geographic coordinates of where each dispensing operation 320(*a-n*) is occurring and/or has occurred. For example, each of the dispensing operations 320(*a-n*) are displayed on the geographic map 310 based the on the geographic coordinates as to where each of the respective storage tanks are located that are on the delivery route for the tanker transport trailer "161".

An icon identifying the geographic location and the status of each of the dispensing operations 320(*a-n*) may also be generated and positioned at the geographic coordinates that each dispensing operation 320(*a-n*) is to occur. The icon may provide a brief description of the status of the dispensing operation. For example as shown in FIG. 3, the each of the icons for the dispensing operations 320(*a-n*) identify the tanker transport trailer that is to be executing the displayed dispensing operations 320(*a-n*) as well as status of "load", "conflict", "partial drop", "drop complete", "drop started", and "new tag". FIG. 3 depicts the status depiction in the legend 330 so that the user may easily identify the status by simply recognizing the visual representation of the status of each dispensing operation 320(*a-n*).

The geographic map enables the user to easily monitor the status of the dispensing operations 320(*a-n*) by simply recognizing the visual representation of the status of each dispensing operation 320(*a-n*). For example, the user may easily identify that the tanker transport trailer "161" completed the "fill" operation in a timely manner based on the dispensing operation 320*a*. The user may then easily identify that the tanker transport trailer "161" completed the dispensing operations 320*b*, 320*c*, and 320*d*, based on the "drop complete" visual representation of the icons for those dispensing operations. However, the user may then easily identify that there is a "conflict" with the dispensing operation 320*e* based on the "conflict" visual representation of the icon for that dispensing operation. Thus, the user may then take swift action to resolve the "conflict" issue so that the tanker transport trailer "161" may complete the dispensing operation 320*e* with minimal delay.

Although, the icons depict basic geographic location and status information for each of the dispensing operations 320(*a-n*), the user may then click on the icon in order to access the detailed liquid product type information for the dispensing operations 320(*a-n*) as displayed in the text-based report depicted in FIG. 2. The geographic map enables the user to obtain a geographic understanding of all the dispensing operations 320(*a-n*) as well as the real-time status updates of each of the dispensing operations 320(*a-n*) in a region so that the user may be able to assess if each of the dispensing operations are being executed as planned. The user may then click on any icon to access detailed liquid product type information should the user request additional liquid product type information for a dispensing operation.

For example, the user may click on the icon associated with the dispensing operation 320*b* as shown in FIG. 3 when the user requests detailed liquid product type information for the dispensing operation 320*b*. In doing so, the user may then have access to the detailed liquid product type information as depicted in FIG. 2 for dispensing operation 210*b*. Thus, the user may easily toggle back and forth between the detailed report shown in FIG. 2 and the geographic map shown in FIG. 3.

In an embodiment, the dispense monitoring computing device 105 may generate a geo-fence around each of the dispensing operations 320(*a-n*) by establishing a geo-fence around the GPS coordinates of each of the dispensing operations 320(*a-n*). The geo-fence identifies a maximum radius from the location of each dispensing operation 320 (*a-n*) that the operator is allowed to dispense liquid product. For example, the maximum radius may be the radius from the storage tanks associated with the dispensing operation 320(*a-n*) in which the operator could conceivably position the tanker transport trailer to successfully dispense the liquid product for the dispensing operation 320(*a-n*). Any position of the tanker transport trailer outside of the maximum radius may be a strong indicator that the operator is attempting to fraudulently dispense the liquid product somewhere other than the storage tanks associated with the dispensing operation 320(*a-n*) and/or has positioned the tanker transport trailer at an incorrect location that differs from the location associated with the dispensing operation 320(*a-n*). The dispense monitoring computing device 105 may then prevent the operator from dispensing liquid product for any of the dispensing operations 320(*a-n*) when the tanker transport trailer is positioned outside of the geo-fence associated with the dispensing operations 320(*a-n*).

For example, the operator has communicated to the dispense monitoring computing device 105 that the operator is ready to initiate dispensing operation 320(*a*). However, the dispense monitoring computing device 105 recognizes that the operator has positioned the tanker transport trailer outside of the geo-fence established for the dispensing operation 320(*a*). The positioning of the tanker transport trailer outside of the geo-fence is a strong indicator that the tanker transport trailer is not positioned within sufficient distance of the storage tanks associated with the dispensing operation 320(*a*) and any type of dispensing may be fraudulent and/or the tanker transport trailer is positioned at the incorrect location to perform the dispensing operation 320(*a*). Thus, the dispense monitoring computing device prevents the operator from initiating the dispensing operation 320(*a*). In an embodiment, the establishment of the geo-fence and the authorization and/or prevention of the dispensing operations 320(*a-n*) based on the geo-fence as discussed in detail above with regards to the dispense monitoring computing device may also be executed by the truck fleet computing device 155, the wand computing device 145 and/or any combination thereof that will be apparent to those skilled in the relevant art(s) without departing from the spirit and scope of the disclosure.

Figure 4:
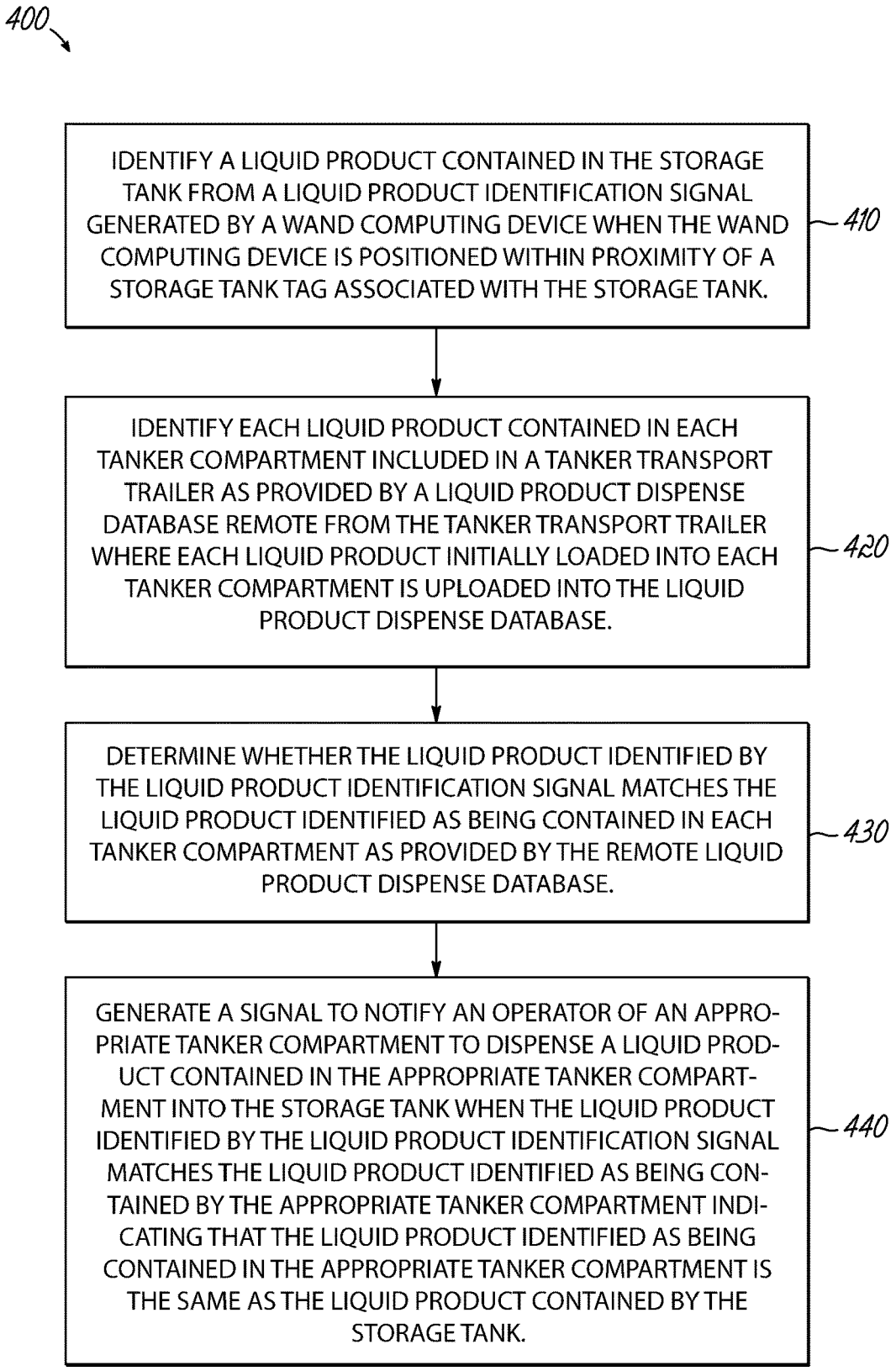
FIG. 4 is a flowchart of exemplary operational steps of the liquid product dispensing monitoring system according to an exemplary embodiment of the present disclosure.

An Exemplary Operational Control Flow of the Liquid Product Dispensing Monitoring System FIG. 4 is a flowchart of exemplary operational steps of the liquid product dispensing monitoring system according to an exemplary embodiment of the present disclosure. The present disclosure is not limited to this operational description. Rather, it will be apparent to persons skilled in the relevant art(s) from the teaching herein that other operational control flows are within the scope and spirit of the present disclosure. The following discussion describes the steps in FIG. 4.

At step 410, the dispense monitoring computing device 105 identifies a liquid product contained in the storage tank 160*n* from a liquid product identification signal 150 generated by the wand computing device 145 when the wand 170 is positioned within proximity of a storage tank tag 140*n* associated with a storage tank 160*n*. For example, the wand 170 generates electromagnetic energy that then triggers the storage tank tag 140*n* to generate the liquid product identification signal 150. The wand communicating device 145 then transmits the liquid product identification signal 150 to the dispense monitoring computing device 105. The liquid product identification signal 150 includes a unique identification code that identifies the liquid product stored in the storage tank 160*n*.

At step 420, the operational control flow identifies each liquid product contained in each tanker compartment 125 (*a-n*) in a tanker transport trailer 180. The dispense monitoring computing device 105 identifies the liquid product based on each unique identification code associated with each corresponding tanker compartment 125(*a-n*) as provided by a liquid product dispense database 115. The liquid product dispense database 115 is remote from the tanker transport trailer 180 and each liquid product contained in each corresponding tanker compartment 125(*a-n*) is uploaded into the liquid product dispense database 115. For example, the liquid product dispense database 115 is part of a cloud computing network and is updated with unique identification codes that identify the liquid product contained in each of the tanker compartments 125(*a-n*).

At step 430, the operational control flow determines whether the liquid product identified by the liquid product identification signal 150 matches the liquid product identified as being contained in each tanker compartment 125(*a-n*) as provided by the remote liquid product dispense database 115. Each unique identification code identifies each liquid product contained each corresponding tanker compartment 125(*a-n*). For example, the dispense monitoring computing device 105 compares the unique identification code associated with the liquid product identification signal 150 with each unique identification code identifying the liquid product in each tanker compartment 125(*a-n*) to determine whether the unique identification code of the liquid product identification signal 150 matches any of the unique identification codes of the liquid products stored in the tanker compartments 125(*a-n*).

At step 440, the operational control flow generates a signal to notify an operator of an appropriate tanker compartment 125*a* to dispense a liquid product contained in the appropriate tanker compartment 125*a* into the storage tank 160*n* when the liquid product identification signal 150 matches the unique identification code corresponding to the appropriate tanker compartment 125*a*. The matching of the unique liquid product identification signal 150 to the unique identification code corresponding to the appropriate tanker compartment 125*a* indicates that the liquid product contained in the appropriate tanker compartment 125*a* is the same as liquid product contained in the storage tank 160*n*.

For example, the dispense monitoring computing device 105 determines that the unique identification code of the liquid product contained in the storage tank 160*n* matches the unique identification code of the liquid product contained in the transport tank 125*a*. The matching of the unique identification code of the liquid product contained in the transport tank 125*a* to the unique identification code of the liquid product contained in the storage tank 160*n* indicates that the liquid product contained in the transport tank 125*a* is the same as the liquid product contained in the storage tank 160*n*. The dispense monitoring computing device 105 then commands the identification tag 190*a* to signal to the operator to dispense the liquid product contained in the tanker compartment 125*a* into the storage tank 160*n*.

CONCLUSION

It is to be appreciated that the Detailed Description section, and not the Abstract section, is intended to be used to interpret the claims. The Abstract section may set forth one or more, but not all exemplary embodiments, of the present disclosure, and thus, are not intended to limit the present disclosure and the appended claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries may be defined so long as the specified functions and relationships thereof are appropriately performed.

It will be apparent to those skilled in the relevant art(s) that various changes in form and detail can be made without departing from the spirit and scope of the present disclosure. Thus the present disclosure should not be limited by any of the above-described exemplary embodiments, but should be defined only in accordance with the following claims and their equivalents.

What is claimed is:

1. A system for confirming that a liquid product is to be dispensed into a storage tank from a tanker compartment before dispensing the liquid product, comprising:

a wand computing device configured to generate a liquid product identification signal when positioned within proximity of a storage tank tag associated with a storage tank, wherein the liquid product identification signal identifies the liquid product contained in the storage tank;

a dispense monitoring computing device configured to:

identify each liquid product contained in each tanker compartment included in a tanker transport trailer as provided by a liquid product dispense database remote from the tanker transport trailer, wherein each liquid product initially loaded into each tanker compartment is uploaded into the liquid product dispense database;

determine whether the liquid product identified by the liquid product identification signal matches the liquid product identified as being contained in each tanker compartment as provided by the remote liquid product dispense database; and generate a signal to notify an operator of an appropriate tanker compartment to dispense a liquid product contained in the appropriate tanker compartment into the storage tank when the liquid product identified by the liquid product identification signal matches the liquid product as being contained by the appropriate tanker compartment indicating that the liquid product contained in the appropriate tanker compartment is the same as the liquid product contained by the storage tank.

2. The system of claim 1, wherein the dispense monitoring computing device is further configured to:

activate a positive lighting feature of an identification tag associated with the selected tanker compartment when the liquid product identified by the liquid product identification signal matches the liquid product identified as being contained by the appropriate tanker compartment to signal to the operator that dispensing of the liquid product contained by the appropriate tanker compartment is to be initiated; and activate a negative lighting feature of the identification tag associated with the appropriate tanker compartment when the liquid product identified by the liquid product identification signal fails to match the liquid product identified as being contained by the appropriate tanker compartment to signal to the operator that dispensing of the liquid product housed by the appropriate tanker compartment is not to be initiated.

3. The system of claim 2, wherein the dispense monitoring computing device is further configured to:

prohibit dispensing of any liquid product contained in any of the tanker compartments to the storage tank when the liquid product identified by the liquid product identification signal fails to match any of the liquid products identified as being contained in any of the tanker compartments.

4. The system of claim 1, wherein a unique identification code is assigned to each liquid product initially loaded into each of the corresponding tanker compartments and is stored in the remote liquid product dispense database to identify each liquid product loaded into each corresponding tanker compartment.

5. The system of claim 4, wherein the dispense monitoring computing device is further configured to:

convert the liquid product identification signal into a unique identification code; and compare the unique identification code of the liquid product identification signal to each unique identification code associated with each tanker compartment provided by the remote liquid product dispense database to determine whether the unique identification code of the liquid product identification signal matches any of the unique identification codes associated with any of the tanker compartments as provided by the remote liquid product database.

6. The system of claim 5, wherein the dispense monitoring computing device is further configured to:

generate the signal to notify the operator of the appropriate tanker compartment to dispense the liquid product contained in the appropriate tanker compartment into the storage tank when the unique identification code identified by the liquid product identification signal matches the unique identification code associated with the appropriate tanker compartment indicating that the liquid product contained in the appropriate tanker compartment is the same as the liquid contained by the storage tank;

and prohibit dispensing of any liquid product contained in any of the tanker compartments to the storage tank when the unique identification code identified by the liquid product identification signal fails to match any of the unique identification codes associated with any of the tanker compartments.

7. The system of claim 1, wherein the dispense monitoring computing device is further configured to:

periodically synchronize with the remote liquid product database to receive accurate liquid product identification information associated with an upcoming dispensing operation, wherein the liquid product identification information is information associated with the upcoming dispensing operation that is pertinent to ensure that the liquid product dispensed into the storage tank is correct.

8. The system of claim 1, wherein the dispense monitoring computing device is further configured to transmit updated liquid product identification data to the liquid product dispense database after the liquid product is dispensed into the storage tank.

9. The system of claim 8, wherein the dispense monitoring computing device is further configured to:

query the liquid product dispense database for updated liquid product identification data associated with each dispensing operation that is executed during a period of time; and generate a report displaying the updated liquid product identification data associated with each dispensing operation that is executed during the period of time.

10. The system of claim 9, wherein the dispense monitoring computing device is further configured to generate a geographic map that depicts each dispensing operation that is being executed during the period of time with each dispensing operation being displayed on the geographic map relative to Global Positioning System (GPS) coordinates of each dispensing operation.

11. The system of claim of claim 10, wherein the dispense monitoring computing device is further configured to generate a geo-fence around a dispensing operation, wherein the geo-fence identifies a radius from a location of the dispensing operation.

12. The system of claim 11, wherein the dispense monitoring computing device is further configured to prevent the dispensing operation when the tanker transport trailer is positioned outside of the geo-fence.

13. The system of claim 11, wherein the dispense monitoring computing device is further configured to enable the dispensing operation when the tanker transport trailer is positioned within the geo-fence.

14. A method for confirming that a liquid product is to be dispensed into a storage tank from a tanker compartment before dispensing the liquid product comprising:

identifying a liquid product contained in the storage tank from a liquid product identification signal generated by a wand computing device when the wand computing device is positioned within proximity of a storage tank tag associated with the storage tank;

identifying each liquid product contained in each tanker compartment included in a tanker transport trailer as provided by a liquid product dispense database remote from the tanker transport trailer, wherein each liquid product initially loaded into each tanker compartment is uploaded into the liquid product dispense database;

determining whether the liquid product identified by the liquid product identification signal matches the liquid product identified as being contained in each tanker compartment as provided by the remote liquid product dispense database; and generating a signal to notify an operator of an appropriate tanker compartment to dispense a liquid product contained in the appropriate tanker compartment into the storage tank when the liquid product identified by the liquid product identification signal matches the liquid product identified as being contained by the appropriate tanker compartment indicating that the liquid product identified as being contained in the appropriate tanker compartment is the same as the liquid product contained by the storage tank.

15. The method of claim 14, further comprising:

activating a positive lighting feature of an identification tag associated with the selected tanker compartment when the liquid product identified by the liquid product identification signal matches the liquid product identified as being contained by the appropriate tanker compartment to signal to the operator that dispensing of the liquid product contained by the appropriate tanker compartment is to be initiated; and activating a negative lighting feature of the identification tag associated with the appropriate tanker compartment when the liquid product identified by the liquid product identification signal fails to match the liquid product identified as being contained by the appropriate tanker compartment to signal to the operator that dispensing of the liquid product contained by the appropriate tanker compartment is not to be initiated.

16. The method of claim 15, further comprising:

prohibiting dispensing of any liquid product contained in any of the tanker compartments to the storage tank when the liquid product identified by the liquid product identification signal fails to match any of the liquid products identified as being contained in any of the tanker compartments.

17. The method of claim 14, further comprising:

assigning a unique identification code to each liquid product initially loaded into each of the corresponding tanker compartments and is stored in the remote liquid product dispense database to identify each liquid product loaded into each corresponding tanker compartment.

18. The method of claim 17, further comprising:

converting the liquid product identification signal into a unique identification code; and comparing the unique identification code of the liquid product identification signal to each unique identification code associated with each tanker compartment provided by the remote liquid product dispense database to determine whether the unique identification code of the liquid product identification signal matches any of the unique identification codes associated with any of the tanker compartments as provided by the remote liquid product database.

19. The method of claim 18, further comprising:

generating the signal to notify the operator of the appropriate tanker compartment to dispense the liquid product contained in the appropriate tanker compartment into the storage tank when the unique identification code identified by the liquid product identification signal matches the unique identification code associated with the appropriate tanker compartment indicating that the liquid product contained in the appropriate tanker compartment is the same as the liquid product contained by the storage tank; and prohibiting dispensing of any liquid product contained in any of the tanker compartments to the storage tank when the unique identification code identified by the liquid product identification signal fails to match any of the unique identification codes associated with any of the tanker compartments.

20. The method of claim 14, further comprising:

periodically synchronizing with the remote liquid product database to receive accurate liquid product identification information associated with an upcoming dispensing operation, wherein the liquid product identification information is information associated with the upcoming dispensing operation that is pertinent to ensure that the liquid product dispensed into the storage tank is correct.

21. The method of claim 14, further comprising:

transmitting updated liquid product identification information to the liquid product dispense database after the liquid product is dispensed into the storage tank.

22. The method of claim 21, further comprising:

querying the liquid product dispense database for updated liquid product identification data associated with each dispensing operation that is executed during a period of time; and generating a report displaying the updated liquid product identification data associated with each dispensing operation that is executed during the period of time.

23. The method of claim 22, further comprising:

generating a geographic map that depicts each dispensing operation that is being executed during the period of time with each dispensing operation being displayed on the geographic map relative to Global Positioning System (GPS) coordinates of each dispensing operation.

24. The method of claim 23, further comprising:

generating a geo-fence around a dispensing operation, wherein the geo-fence identifies a radius from a location of the dispensing operation.

25. The method of claim 24, further comprising:

preventing the dispensing operation when the tanker transport trailer is positioned outside of the geo-fence.

26. The method of claim 24, further comprising:

enabling the dispensing operation when the tanker transport trailer is positioned within the geo-fence.

* * * * *